United States Patent [19]

Shaw et al.

[11] 4,335,582

[45] Jun. 22, 1982

[54] UNLOADING CONTROL SYSTEM FOR HELICAL SCREW COMPRESSOR REFRIGERATION SYSTEM

[75] Inventors: David N. Shaw, Unionville; Norman A. L. N. Gagnon, Windsor Locks, both of Conn.

[73] Assignee: Dunham-Bush, Inc., West Hartford, Conn.

[21] Appl. No.: 236,372

[22] Filed: Feb. 20, 1981

[51] Int. Cl.[3] ..... F04B 49/00

[52] U.S. Cl. ..... 62/196 R; 62/228; 417/310

[58] Field of Search ..... 62/228 C, 176.3, 196 R, 62/510; 417/310

[56] References Cited

U.S. PATENT DOCUMENTS 3,408,827 11/1968 Soumerai et al. ..... 62/228 C 4,249,866 2/1981 Shaw et al. ..... 417/310 X

*Primary Examiner*—William E. Wayner

*Attorney, Agent, or Firm*—Sughrue, Mion, Zinn, MacPeak & Seas

[57] ABSTRACT

A check valve within a closed loop refrigeration system isolates the evaporator from the helical screw compressor. A normally open, solenoid operated valve is positioned within an unload line having one end coupled to a drive cylinder outboard chamber to the side of the piston opposite an inboard chamber which opens to compressor discharge pressure. The other end of the unload line is connected to the system low pressure side, downstream of the check valve. The same drive cylinder outboard chamber opens via a load line to the system high pressure side through a normally closed solenoid operated valve. Upon compressor shut down, the outboard chamber is vented to the system low pressure side, while the opposite side of the unloader drive cylinder piston sees the compressor high side, thus driving the slide valve to full unload position and eliminating the coil spring normally needed to drive the slide valve to that position.

3 Claims, 1 Drawing Figure

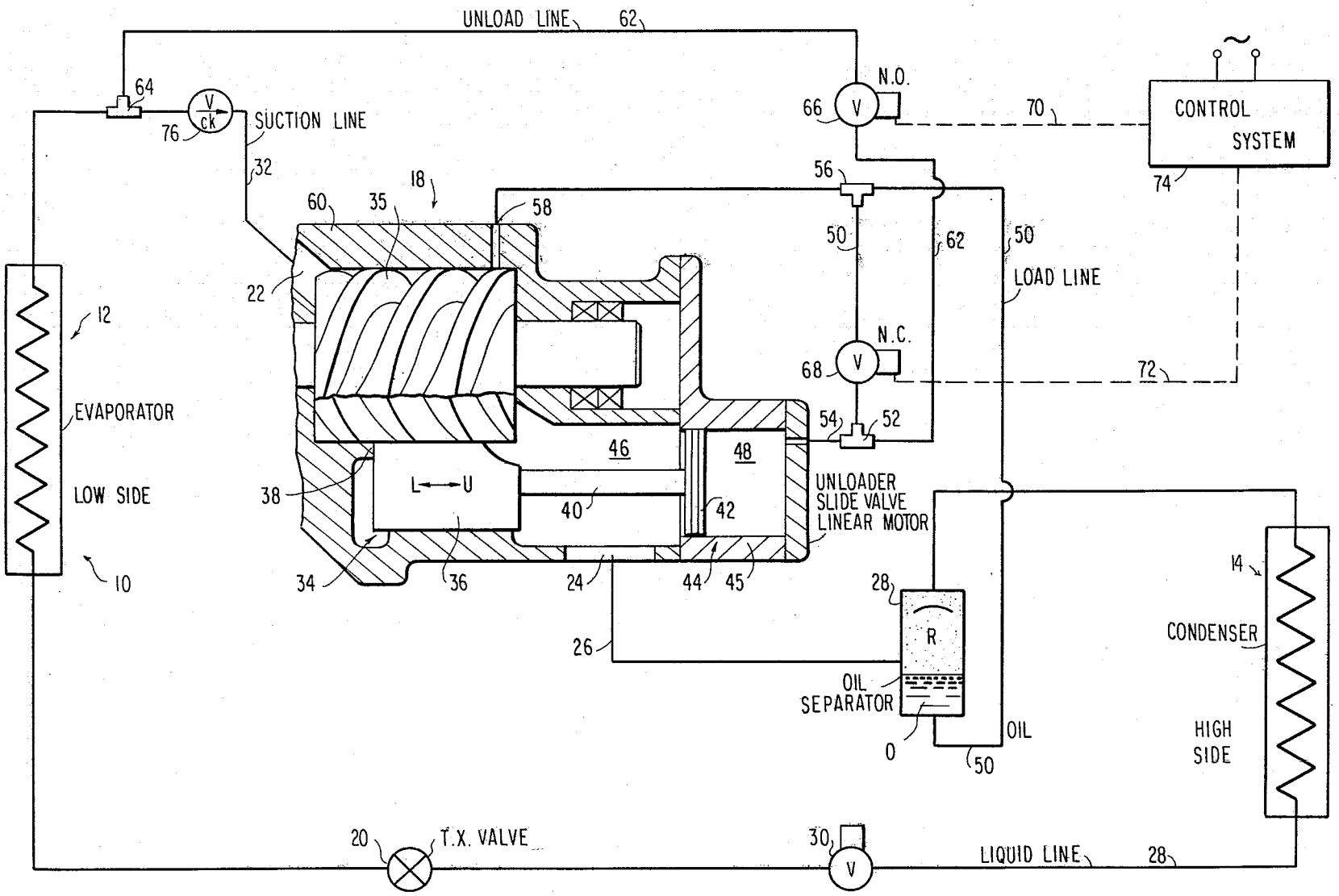
CONTROL SYSTEM
74
72
70
LOAD LINE
50
62
N.O.
N.C.
66
68
56
52
54
UNLOADER SLIDE VALVE LINEAR MOTOR
48
42
45
44
46
40
24
26
58
18
35
60
22
38
34
36
L
U
UNLOAD LINE
SUCTION LINE
32
76
64
12
EVAPORATOR
LOW SIDE
10
CONDENSER
14
HIGH SIDE
28
LIQUID LINE
OIL
R
OIL SEPARATOR
0
30
T.X. VALVE
20

UNLOADING CONTROL SYSTEM FOR HELICAL SCREW COMPRESSOR REFRIGERATION SYSTEM

FIELD OF THE INVENTION

This invention relates to closed loop refrigeration systems employing helical screw compressors bearing reciprocating slide valves, and more particularly, to an unloading arrangement for insuring slide valve movement to full unload position at compressor shut down without the necessity for positive spring means to perform that function.

BACKGROUND OF THE INVENTION

Refrigeration and air conditioning systems have long employed helical screw rotary compressors as an element within a closed loop refrigeration circuit, with the compressor, condenser and evaporator connected in that order in series within the closed loop and with a thermal expansion valve or similar expansion means intermediate of the condenser and evaporator and thereby defining system high and low side pressure to opposite sides of the expansion means. Further, such helical screw compressors are often characterized by an unloader slide valve which is shiftable longitudinally to the screw compressor casing and forming a part of the envelope for the intermeshed helical screw rotors, wherein the compression process takes place. Such slide valves are fixedly coupled to a piston which is sealably carried within an unloader slide valve linear drive cylinder aligned with the slide valve and extending from the compressor casing. The slide valve itself is shiftable between extreme full load and unload positions. In the unload position, a large portion of the refrigerant gas entering the compressor at the suction port is permitted to return to the suction side of the compressor to the extent of linear displacement of the slide valve from a fixed stop defining a full load position. When the slide valve shifts towards that stop, by-pass or return of the gas is restricted and the refrigerant gas entering the suction port must be compressed by the compressor which discharges at high pressure at a discharge port. The high pressure compressed gas is directed to the high side of the machine for condensation within the condenser and ultimate feed as a liquid through the thermal expansion valve or similar expansion means to the evaporator. Here vaporization of the refrigerant occurs, prior to return as a low pressure vapor to the suction port of the compressor.

Further, conventionally, oil is fed to the bearings of the compressor, and is preferably injected directly into the compression process through one or more injection ports within the compressor casing where it mixes with the refrigerant. Downstream of the compressor and upstream of the condenser, an oil separator is conventionally provided within the closed loop. Oil is separated from the refrigerant, which refrigerant then circulates in the closed loop. The oil is returned to the compressor with a portion thereof injected directly into the working chamber as defined by the intermeshed helical screw rotors. The linear drive cylinder is preferably a hydraulic cylinder, and the piston which is sealably and slidably mounted within the cylinder defines closed chambers on opposite sides. An inboard chamber is proximate to the compressor itself, and an outboard chamber is remote from the compressor. Typically, a coil spring is interposed in the compressor slide valve assembly and acts directly on either the slide valve or the slide valve drive cylinder piston to bias the slide valve into full compressor unload position providing maximum by-pass or return of the suction gas entering the compressor working chamber.

In order to effect loading of the compressor, depending upon system load conditions, the separated oil, which is at discharge pressure (or further pressurized by an oil pump), is directed to the outboard chamber to drive the slide valve in a direction tending to close off the by-pass opening or gap between the slide valve and the fixed stop, i.e., towards full load position. While this system operates fairly satisfactorily in practice, it is complicated and is subject to possible problems should the spring break or hang up. Additionally, in order to shift the slide valve in opposition to the spring bias, some work must be overcome, therefore providing, at least to some extent a power loss.

It is, therefore, a primary object of the present invention to provide an improved unloading control system for a helical screw operated, closed loop refrigeration or air conditioning system which is simple in operation, which is automatically effected during compressor shut down and in which, the need for a spring for biasing the slide valve to unload position is eliminated.

SUMMARY OF THE INVENTION

The invention is directed to a closed loop refrigeration system employing a compressor, a condenser and an evaporator connected in a closed series loop by conduit means, in that order, with a thermal expansion means interposed between the condenser and the evaporator, forming a system low pressure side at the evaporator and maintaining a system high pressure side at the condenser. The compressor comprises a helical screw compressor bearing an unloader slide valve which is movable between compressor full load and full unload positions. A drive cylinder is operatively coupled to the slide valve and includes a piston sealably and slidably carried within the cylinder and connected to the slide valve for shifting the slide valve between said positions with the cylinder forming with the piston, an outboard chamber to the side of the piston remote from the slide valve and an inboard chamber on the opposite side thereof. The inboard chamber is open to the compressor discharge pressure such that the discharge pressure tends to shift the slide valve to full unloaded position. The conduit means includes means for selectively connecting the outboard chamber to the compressor discharge pressure, tending to shift the slide valve towards the full load position. The improvement resides in a check valve between the evaporator and the compressor suction port within said conduit means, means normally closing off the outboard chamber to the system high pressure side, and means for normally opening the outboard chamber to the system low side pressure upstream of the check valve, whereby; upon compressor shut down, the outboard chamber is vented to the system low side, while the inboard chamber is opened to the system high side, and wherein during the time required for the average system to equalize, a pressure differential shifts the slide valve to compressor full unload position.

The conduit means preferably includes an unload control line connected at one end to the outboard chamber and at its opposite end to the closed loop conduit at a point between the evaporator and the compressor, and upstream of the check valve. A normally open solenoid operated valve is provided within the unload line. A load line is connected at one end to the closed loop at a point between the compressor discharge port and the condenser and is connected at its other end, to the outboard chamber. A normally closed solenoid operated valve is provided within the load line, and the system is provided with control means for energizing both solenoid operated valves only during compressor operation, such that during compressor shut down, the slide valve is forced to the fully unloaded position as a result of pressure differential across the piston. The closed loop refrigeration system can be of the oil flooded type with an oil separator within the closed loop between the discharge port of the compressor and the condenser, and the load line may comprise an oil line connected at one end to the oil separator and at its opposite end to the outboard chamber and having a branch line leading to a compressor casing oil injection port which opens to the compression process at a point intermediate of the compressor suction and discharge ports.

BRIEF DESCRIPTION OF THE DRAWING

The single FIGURE is a schematic diagram of a closed loop refrigeration system incorporating the improved, automatic controlled unloading system for the screw compressor at compressor shut down and forming a preferred embodiment of the present invention.

DESCRIPTION OF THE PREFERRED EMBODIMENT

Referring to the drawing, there is shown a closed loop refrigeration system indicated generally at 10, which may be employed for commercial refrigeration or which may function in a heat pump format. An evaporator and a condenser, indicated generally at 12 and 14 are connected, with a compressor 18 within a closed refrigeration loop by conduit means indicated generally at 16, bearing a refrigerant R such as R-22. The closed refrigeration loop includes as principal components, the evaporator 12, the condenser 14, and a helical screw rotary compressor 18; compressor 18 being interposed between the evaporator 12 and the condenser 12. Typically, a thermal expansion valve, as at 20, is provided to expand the compressed refrigerant prior to entry into the evaporator 12. The helical screw compressor 18 is provided with a low pressure suction port at 22 and a high pressure discharge port at 24. The discharge port 24 connects via a discharge line 26 to an oil separator 28 interposed between the compressor 18 and the condenser 14. The conduit means includes a discharge line 26 which is connected to the condenser 14 downstream of the oil separator. The refrigerant vapor R such as R-22 condenses from the gaseous or vapor state form to a liquid. A liquid line 28 is connected to the condenser 14 on its discharge side and connects to the evaporator 12 at the inlet side thereof. A suitable solenoid operated shut-off valve 30 is incorporated within the liquid line, upstream of the thermal expansion valve 20. Due to the pressure drop across the thermal expansion valve 20, the high pressure liquid refrigerant vaporizes, its pressure is reduced, and during vaporization within evaporator 12, its removes heat by such vaporization, in conventional evaporator function. The refrigerant in vapor form returns to the compressor via suction line 32 which connects at one end to the discharge side of the evaporator 12, and at its opposite end to the suction port 22 of the helical screw compressor 18.

The helical screw compressor 18 bears a slide valve indicated generally at 34 including a slide valve member 36 which shifts longitudinally relative to the intermeshed helical screw rotors 35 borne by the compressor casing 60. The slide valve member 36 forms a part of the compressor envelope. Schematically, the slide valve member 36 is shown in full load position, with the slide valve member abutting a stop 38 and preventing the return of refrigerant in uncompressed vapor form, back to the suction port 22 or low side of the machine, and thus bypassing the compression process between the suction port 22 and discharge port 24 of the compressor 18. The slide valve member 36 is connected via a piston rod 40 to piston 42 of a unloader slide valve linear motor indicated generally at 44. A cylinder 45 bears the piston 42 which is sealably and slidably mounted therein, thus sealably separating an inboard chamber 46 from an outboard chamber 48, on opposite sides of piston 42. The inboard chamber 46 is open to the discharge side of the compressor and thus with the compressor operating, is at relatively high pressure. The outboard chamber 48 is subjected to fluid pressure to create a pressure differential across the piston and to shift the slide valve member 36 towards and away from full load position shown in the drawing, that is, with the slide valve member 36 abutting stop 38.

In the illustrated embodiment, this is achieved by utilizing oil O which fills a portion of the oil separator 28, the oil being removed from the oil separator via an oil load line 50. The oil load line 50 is connected via a Tee 52 and line 54 to the outboard chamber 48 of the drive cylinder 44. In addition, by means of a second Tee 56, the load line connects to an oil injection port 58 opening within casing 60 of compressor 18 directly to the intermeshed screws and the working chamber (not shown) of the compressor, at an intermediate pressure point within the compression process, that is, at a pressure level which is in excess of the pressure at suction port 22 but lower than the pressure at compressor discharge port 24.

Further, the control scheme of the invention is characterized by the utilization of an unload line 62 which connects via Tee 64 to the suction line 32 at a point intermediate of the evaporator 12 and the compressor suction port 22. The unload line 62 connects, at its opposite end, to Tee 52 and thus connects, via line 54, to the unloader slide valve drive motor outboard chamber 48. The unload line bears a normally open solenoid operated valve 66, while the load line bears a normally closed solenoid operated valve 68. The valves are connected, respectively, by electrical lines 70 and 72 to an electrical source via the control system indicated schematically at 74 such that during operation of the compressor 18, electrical current is provided through lines 70 and 72 for energizing the solenoid operated valves 66 and 68. The control system 74 is programmed such that whenever the electrical motor (not shown) operates to drive compressor 18, the valves 66 and 68 are energized, and when the compressor is shut down, the solenoid operated valves 66 and 68 are de-energized.

The control scheme is further characterized by the incorporation of a check valve 76 within the suction line downstream of the connection point for unload line 62.

As may be appreciated, the unloading control scheme incorporated within the closed loop refrigeration system provides for system operation with the compressor unloaded at start and without the need for a coil spring or other positive drive member for shifting piston 52 or slide valve member 36 to its full unload position when the compressor is shut down. By utilizing the normally closed solenoid operated valve 68 within load line 50, the normally open solenoid operated valve 66 within the unload line and the connecting of the unload line upstream of the suction check valve 76, upon compressor shut down the outboard chamber 48 and thus the outboard side of the unloader piston 42 is vented to the system low pressure side or low side, while the inboard chamber 46 or inboard side of the unloader piston 42 sees the system high side (since there is no discharge check valve within discharge line 26).

The invention is predicated on a time delay at shut down of the compressor, which is normal for the average system to equalize the low side pressure to high side pressure and which time delay is normally more than adequate for the unloader piston 42 to be shifted by suction pressure applied to chamber 48 during de-energization of solenoid operated valve 66, by opening that chamber to the suction or low side of the machine. Simultaneously by de-energization of the solenoid operated valve 68, the load line is closed off at this point to the discharge side of the compressor and thus the system high side.

Advantageously, the load line is connected to the oil separator so as to receive oil under system discharge pressure or at a higher pressure by use of an oil pump to insure that during normal compressor operation a sufficiently high pressure within the outboard chamber 48 acts to drive the slide valve member 36 to full load position against stop 38, regardless of compressor discharge pressure acting directly within chamber 46 on the opposite side of piston 42.

The oil pump is not necessary even when both sides of the piston are at the same pressure (when loading) as there is a net pressure difference across the slide valve that causes a net force tending to move the valve and piston assembly to the load position.

While the invention has been particularly shown and described with reference to a preferred embodiment thereof, it will be understood by those skilled in the art that various changes in form and details may be made therein without departing from the spirit and scope of the invention.

What is claimed is:

1. In a closed loop refrigeration system including
a compressor,
a condenser, and
evaporator,
conduit means connecting said compressor, condenser and evaporator in series, in that order within a closed loop,
said conduit means including an expansion means upstream of said evaporator,
and wherein said compressor comprises;
a helical screw rotary compressor having a low pressure suction port and a high pressure discharge port,
an unloader slide valve movable between compressor full load and full unload position,
a linear drive motor including a slidable piston sealably and slidably mounted within a cylinder and forming inboard and outboard chambers on opposite sides of said piston, said inboard chamber being open to the compressor discharge pressure and tending to shift the slide valve to full compressor unload position and wherein said conduit means further includes means for selectively connecting said outboard chamber to the compressor discharge pressure tending to shift said slide valve to full compressor load position,
the improvement comprising:
a check valve within said conduit means between said evaporator and said compressor suction port,
means normally closing off said outboard chamber to said system high side pressure and
means for normally opening said outboard chamber to said system low side pressure upstream of said check valve means;
whereby, upon compressor shut down, the outboard chamber is vented to the system low side pressure, while the inboard chamber is open to the system high side pressure, such that during the time delay to achieve equalization of system high and low side pressures, said unloader piston and said slide valve are automatically shifted to compressor full unload position.

2. The system as claimed in claim 1, wherein said conduit means includes an unload control line connected at one end to said outboard chamber and at its opposite end to said closed loop at a point between said evaporator and said compressor and upstream of said check valve, a normally open solenoid operated valve is provided within said unload line, a load line is connected at one end to said outboard chamber and at its opposite end to said closed loop intermediate of said compressor and said condenser, and a normally closed solenoid operated valve is provided within said load line and wherein said system further comprises control means for energizing both solenoid operated valves only during compressor operation such that, at compressor shut down, said outboard chamber is cut off from the system high side pressure through said load line and is connected to system low side pressure through said unload line.

3. The system as claimed in claim 2, wherein said compressor is of the oil flooded type, and said system includes an oil separator within said closed loop conduit means intermediate of said compressor and said condenser, and said load line comprises an oil line opening at one end to said oil separator and at its opposite end to said outboard chamber, and wherein said oil line further comprises a bleed line opening to an injection port within the casing of said helical screw compressor which opens to the compressor working chamber at a point intermediate of said suction port and said discharge port.

* * * * *